US011423819B1

(12) United States Patent
Furihata et al.

(10) Patent No.: US 11,423,819 B1
(45) Date of Patent: Aug. 23, 2022

(54) OVERSHOOT DRIVING TECHNIQUE FOR DISPLAY PANEL WITH MULTIPLE REGIONS WITH DIFFERENT PIXEL LAYOUTS

(71) Applicant: Synaptics Incorporated, San Jose, CA (US)

(72) Inventors: Hirobumi Furihata, Tokyo (JP); Takashi Nose, Kanagawa (JP); Masao Orio, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/496,751

(22) Filed: Oct. 7, 2021

(51) Int. Cl.
*G09G 3/20* (2006.01)

(52) U.S. Cl.
CPC ..... *G09G 3/20* (2013.01); *G09G 2300/0439* (2013.01); *G09G 2320/0673* (2013.01)

(58) Field of Classification Search
CPC ..... G09G 2300/0443; G09G 2320/028; G09G 2340/16; G09G 3/20; G09G 3/2074; G09G 5/00
See application file for complete search history.

(56) References Cited

U.S. PATENT DOCUMENTS

2008/0158454 A1* 7/2008 Shin ..... G09G 3/3607 349/36
2009/0002585 A1* 1/2009 Shimoshikiryoh .. G09G 3/3614 349/39
2011/0242140 A1* 10/2011 Lee ..... G09G 3/3648 345/89
2015/0002503 A1* 1/2015 Park ..... G09G 3/3614 345/212
2020/0358930 A1* 11/2020 Nicholson ..... G06F 1/1626

FOREIGN PATENT DOCUMENTS

WO WO-2015138130 A1 * 9/2015 ..... H01J 37/3026

* cited by examiner

*Primary Examiner* — Gerald Johnson
(74) *Attorney, Agent, or Firm* — Ferguson Braswell Fraser Kubasta PC

(57) ABSTRACT

A display driver includes image processing circuitry and drive circuitry. The image processing circuitry is configured to receive first subpixel data for a first scan line of a display panel. The display panel includes a first region with a first pixel layout and a second region with a second pixel layout different from the first pixel layout. The image processing circuitry is further configured to determine an overshoot amount based, at least in part, on the first subpixel data and region indication data and generate resulting voltage data using the overshoot amount. The region indication data indicates whether the resulting voltage data is for the first region or for the second region. The drive circuitry is configured to drive the display panel based, at least in part, on the resulting voltage data.

20 Claims, 16 Drawing Sheets

OVERSHOOT DRIVING TECHNIQUE FOR DISPLAY PANEL WITH MULTIPLE REGIONS WITH DIFFERENT PIXEL LAYOUTS

FIELD

The disclosed technology generally relates to devices and methods for driving display panels, more particularly, to overshoot driving technologies for display panels with multiple regions with different pixel layouts.

BACKGROUND

Recent display devices may be configured with increased display resolutions and/or increased frame rates. The increase in the display resolution and/or frame rate may necessitate updating subpixels coupled to a selected scan line within a short horizontal synchronization period. One approach to drive the subpixels within a short horizontal synchronization period is overshoot driving, which is a technique for enhancing changes in the voltages on the data lines coupled to subpixels. Display drivers configured to drive display panels are therefore often designed to be adapted to the overshoot driving.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes image processing circuitry and drive circuitry. The image processing circuitry is configured to receive first subpixel data for a first scan line of a display panel. The display panel includes a first region with a first pixel layout and a second region with a second pixel layout different from the first pixel layout. The image processing circuitry is further configured to determine an overshoot amount based, at least in part, on the first subpixel data and region indication data and generate resulting voltage data using the overshoot amount. The region indication data indicates whether the resulting voltage data is for the first region or for the second region. The drive circuitry is configured to drive the display panel based, at least in part, on the resulting voltage data.

In one or more embodiments, a display device is provided. The display device includes a display panel and a display driver. The display panel includes a first region with a first pixel layout and a second region with a second pixel layout different from the first pixel layout. The display driver is configured to receive first subpixel data for a first scan line of a display panel, determine an overshoot amount based, at least in part, on the first subpixel data and region indication data, and generate resulting voltage data using the overshoot amount. The region indication data indicates whether the resulting voltage data is for the first region or for the second region. The display driver is further configured to drive the display panel based, at least in part, on the resulting voltage data.

In one or more embodiments, a method for achieving overshoot driving is provided. The method includes determining an overshoot amount based on first subpixel data for a first scan line of a display panel, second subpixel data for a second scan line of the display panel, and region indication data. The display panel includes a first region with a first pixel layout and a second region with a second pixel layout different from the first pixel layout. The second scan line is activated prior to the first scan line. The method further includes generating resulting voltage data using the overshoot amount, the first subpixel data, and the second subpixel data. The region indication data indicates whether the resulting voltage data is for the first region or for the second region.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1A:
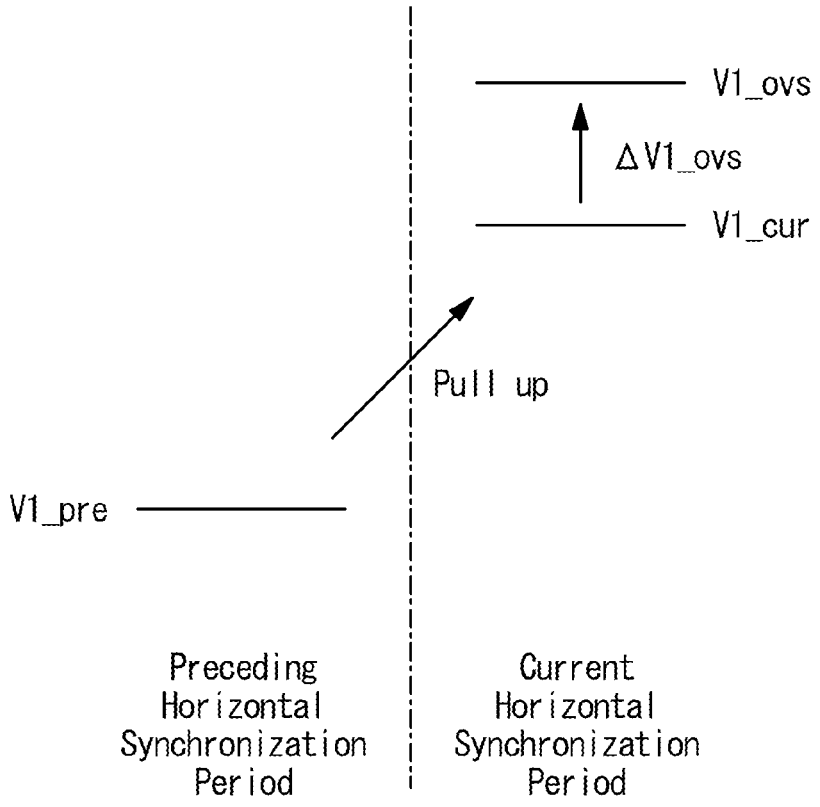
FIG. 1A and FIG. 1B illustrate example overshoot driving, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

The trend in recent display devices is toward high resolution and high frame rate to provide improved user experiences. The increase in the display resolution and/or frame rate may be accompanied by a reduction in the duration of one horizontal synchronization period, which is a period during which subpixels coupled to one scan line (which may be also referred to as gate line) are updated or programmed.

One approach to drive the subpixels within a reduced horizontal synchronization period is overshoot driving, which is a technique for enhancing changes of the voltages on the data lines coupled to subpixels. In one implementation, the overshoot driving may be achieved by adjusting the voltage levels of drive voltages applied to data lines to update subpixels coupled to the data lines.

FIG. 1A illustrates an example overshoot driving for a specific data line, according to one or more embodiments. In one implementation, the voltage level of a drive voltage to be applied to the data line during each horizontal synchronization period is specified by subpixel data. In the illustrated embodiment, a voltage level V1_cur is specified for the current horizontal synchronization period and a voltage level V1_pre is specified for the preceding horizontal synchronization period, where the voltage level V1_cur is higher than the voltage level V_pre. In this case, the overshoot driving increases the voltage level of the drive voltage for the current horizontal synchronization period by an overshoot amount ΔV1_ovs. The overshoot amount ΔV1_ovs is positive when the voltage level V1_cur is higher than the voltage level V1_pre. In various embodiments, the overshoot amount ΔV1_ovs may be based on the difference between the voltage level V1_pre and the voltage level V1_cur. In one implementation, the overshoot amount ΔV1_ovs may increase as the difference increases.

Figure 1B:
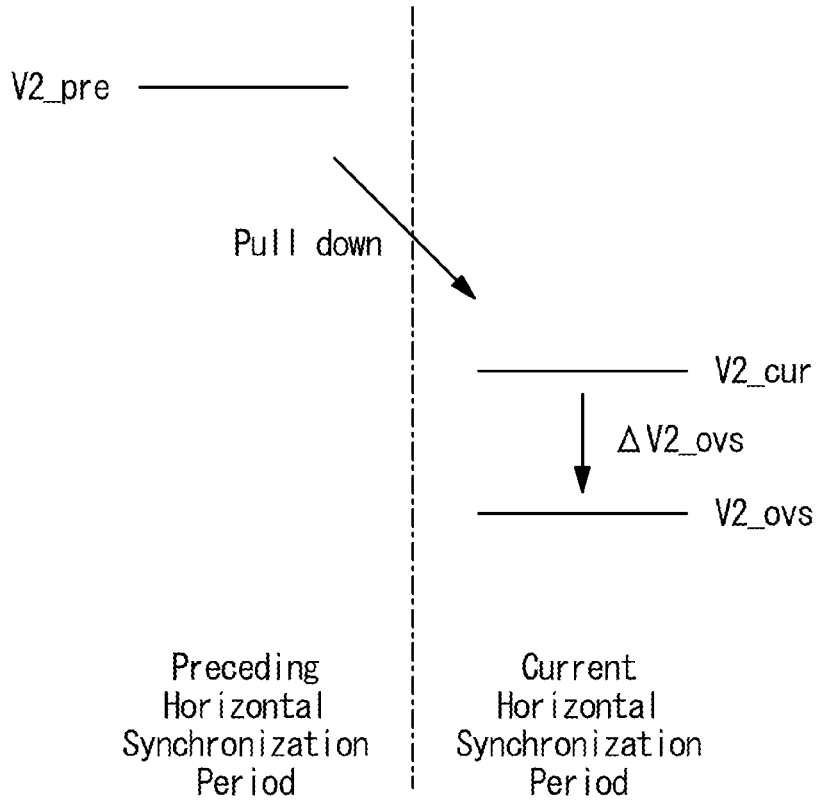

FIG. 1B illustrates another example overshoot driving. In the illustrated embodiment, a voltage level V2_cur is specified for the current horizontal synchronization period and a voltage level V2_pre is specified for the preceding horizontal synchronization period, where the voltage level V2_cur is lower than the voltage level V2_pre. In this case, the overshoot driving decreases the voltage level of the drive voltage for the current horizontal synchronization period by an overshoot amount ΔV2_ovs. The overshoot amount ΔV2_ovs is negative when the voltage level V2_cur is lower than the voltage level V2_pre. In various embodiments, the overshoot amount ΔV2_ovs may be based on the difference between the voltage level V2_pre and the voltage level V2_cur. In one implementation, the absolute value of the overshoot amount ΔV2_ovs may increase as the absolute value of the difference increases.

A display panel may include multiple regions with different pixel layouts. The pixel layout difference may include a difference in one or more of the size, configuration, and arrangement of the pixels and/or a difference in one or more of the size, configuration, arrangement, and number of subpixels in each pixel. Since the pixel layout difference may cause a difference in the display characteristics, it would be advantageous for improving the display image quality if the overshoot driving is performed adaptively to the difference in the display characteristics. The present disclosure provides various technologies for overshoot driving adapted to a display panel that includes regions with different pixel layouts.

In one or more embodiments, a display driver includes image processing circuitry and drive circuitry. The image processing circuitry is configured to receive first subpixel data for a first scan line of a display panel. The display panel includes a first region with a first pixel layout and a second region with a second pixel layout different from the first pixel layout. The image processing circuitry is further configured to determine an overshoot amount based, at least in part, on the first subpixel data and region indication data and generate resulting voltage data using the overshoot amount. The region indication data indicates whether the resulting voltage data is for the first region or for the second region. The drive circuitry is configured to drive the display panel based, at least in part, on the resulting voltage data. In the following, a detailed description is given of embodiments of the present disclosure.

Figure 2A:
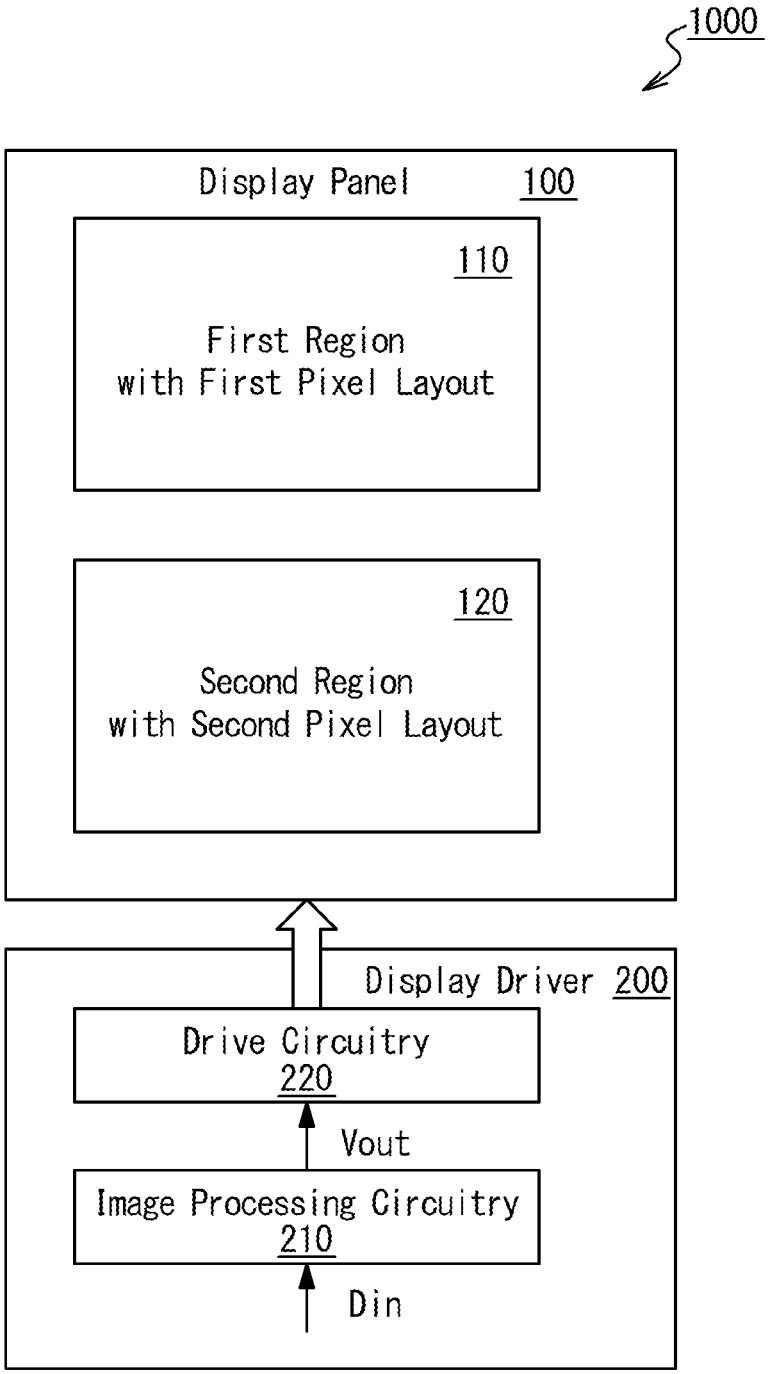
FIG. 2A illustrates an example configuration of a display device, according to one or more embodiments.

FIG. 2A illustrates an example configuration of a display device 1000 that includes a display panel 100 including two regions with different pixel layouts, according to one or more embodiments. Examples of the display panel 100 may include an organic light emitting diode (OLED) display, a micro light emitting diode (LED) display, and a liquid crystal display (LCD) panel. Although only two regions are shown, more than two regions may exist without departing from the scope of one or more embodiments.

In the illustrated embodiment, the display panel 100 includes a first region 110 with a first pixel layout and a second region 120 with a second pixel layout different from the first pixel layout. The display panel 100 is coupled to a display driver 200 configured to drive the display panel 100 based on image data Din. The image data Din may include subpixel data for respective subpixels in the display panel 100. The subpixel data for a subpixel may include a gray-level that corresponds to a desired luminance of the subpixel.

The display driver 200 includes image processing circuitry 210 and drive circuitry 220. The image processing circuitry 210 is configured to apply one or more image processes to the image data Din to generate resulting voltage data Vout. The resulting voltage data Vout may include voltage levels of drive voltages with which the respective subpixels in the display panel are updated. The drive circuitry 220 is configured to drive the display panel 100 based at least in part, on the resulting voltage data Vout.

In various embodiments, the image processing circuitry 210 may be configured to receive first subpixel data for a first scan line of the display panel 100. The image processing circuitry 210 may be further configured to determine an overshoot amount based, at least in part, on the first subpixel data and region indication data. The image processing circuitry 210 is further configured to generate resulting voltage data for the first subpixel using the overshoot amount. The region indication data indicates whether the resulting voltage data is for the first region 110 or for the second region 120.

Figure 2B:
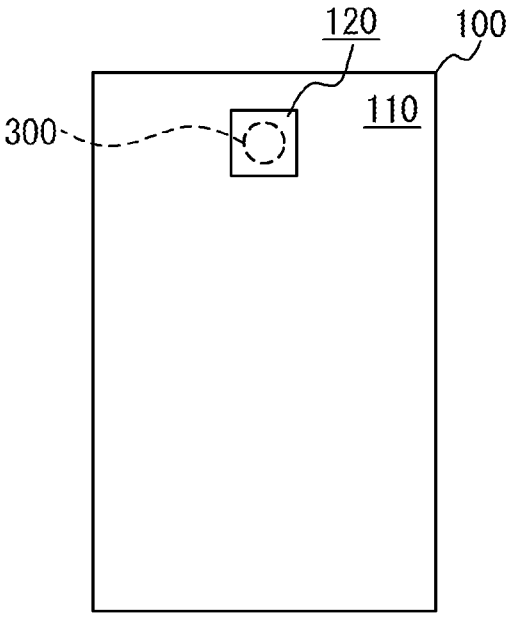
FIG. 2B illustrates an example configuration of a display panel, according to one or more embodiments.

The shape, size, arrangement, and number of regions may differ than shown. For example, the first region 110 and the second region 120 may be variously modified, not limited to the arrangement illustrated in FIG. 2A. FIG. 2B illustrates an example arrangement of the first region 110 and the second region 120, according to one or more embodiments. In the illustrated embodiment, the second region 120 is defined as a rectangular region surrounded by the first region 110. In one implementation, the second region 120 may be configured as a camera hole region in which the pixel density (which may be measured as pixel-per-inch (PPI)) is reduced compared to the first region 110, and a camera 300 may be disposed behind the second region 120. In the following, various embodiments of the present disclosure will be described in detail.

Figure 3A:
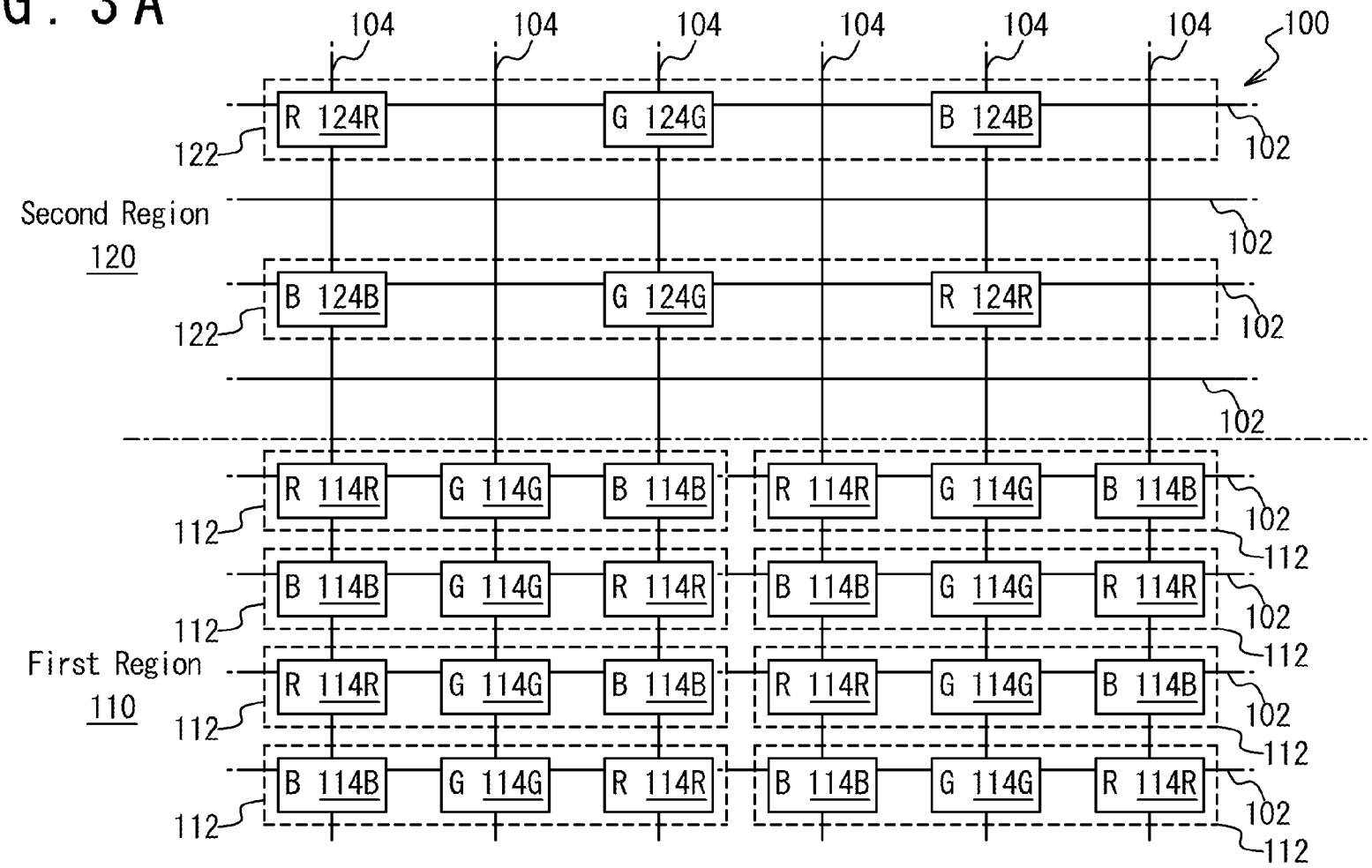
FIG. 3A illustrates an example configuration of a display panel, according to one or more embodiments.

FIG. 3A illustrates an example configuration of the display panel 100, especially depicting example pixel layouts of the first region 110 and the second region 120, according to one or more embodiments. In FIG. 3A, the reference numerals 102 denote scan lines (which may also be referred to as gate lines) and the reference numerals 104 denote data lines (which may also be referred to as source lines). In the illustrated embodiment, the first region 110 includes pixels 112 each including a red (R) subpixel 114R, a green (G) subpixel 114G, and a blue (B) subpixel 114B. The R subpixel 114R, the G subpixel 114G, and the B subpixel 114B may be collectively referred to as subpixels 114. The second region 120 includes pixels 122 each including a R subpixel 124R, a G subpixel 124G, and a B subpixel 124B. The R subpixel 124R, the G subpixel 124G, and the B subpixel 124B may be collectively referred to as subpixels 124.

In the illustrated embodiment, the second region 120 is configured such that the pixel density of the second region 120 is lower than the pixel density of the first region 110. More specifically, the first region 110 is configured such that the subpixels 114 are disposed for all the combinations of the scan lines 102 and the data lines 104, while the second region 120 is configured such that the subpixels 124 are disposed at only part of the combinations of the scan lines 102 and the data lines 104. It is noted that image data Din provided to the image processing circuitry 210 may include subpixel data for every combination of the scan lines 102 and the data lines 104 regardless of whether or not a subpixel 114 or 124 is disposed for the combination.

Figure 3B:
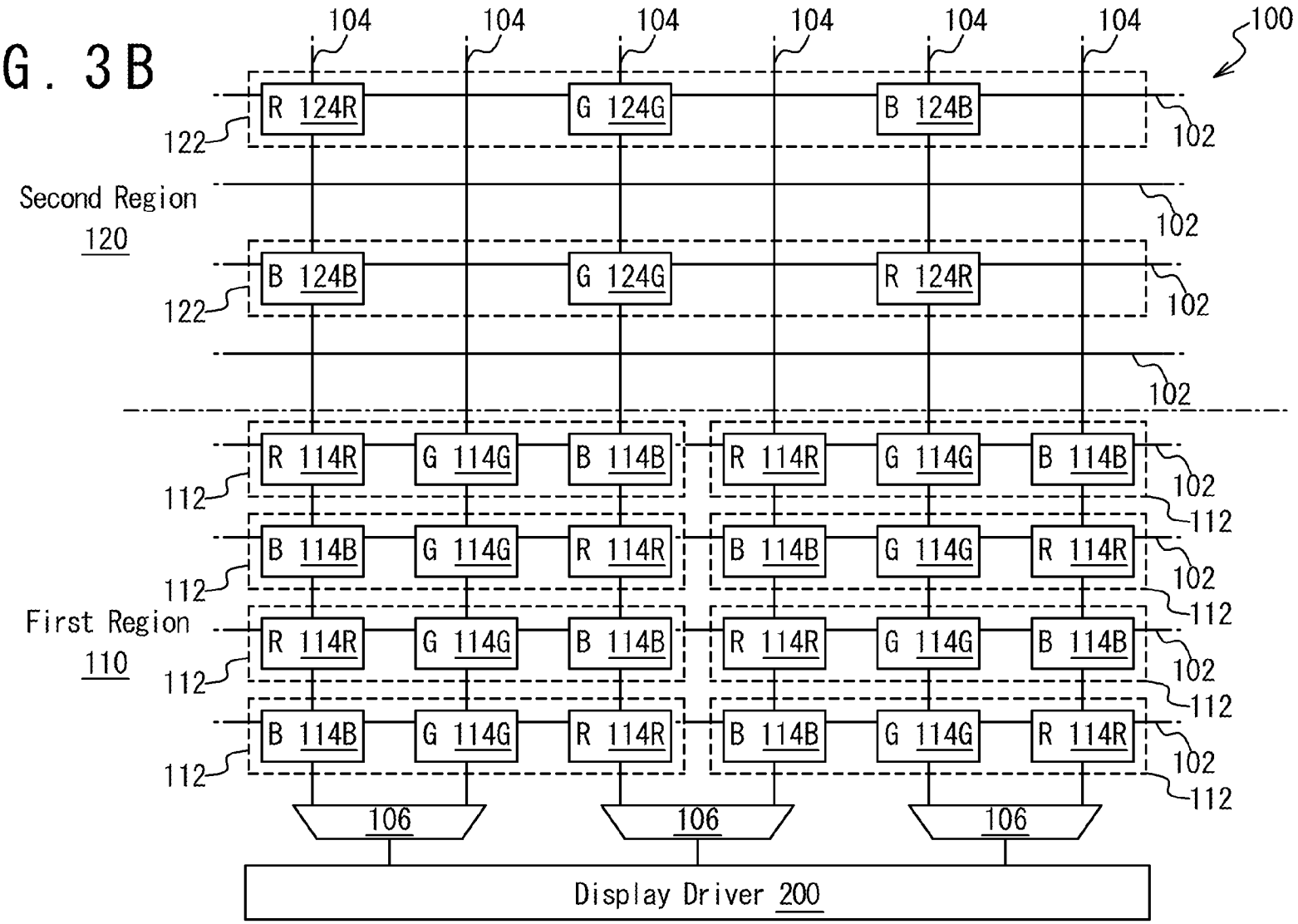
FIG. 3B illustrates an example configuration of a display panel, according to other embodiments.

In other embodiments, as illustrated in FIG. 3B, the display panel 100 may include multiplexers 106 configured to electrically connect selected ones of the data lines 104 to the display driver 200. The multiplexers 106 may be used for time division driving, which involves sequentially driving the data lines 104 coupled to each multiplexer 106 in each horizontal synchronization period. In the illustrated embodiment, each multiplexer 106 is coupled to two data lines 104 and configured to electrically connect one of the two data lines 104 to the display driver 200.

Figure 4:
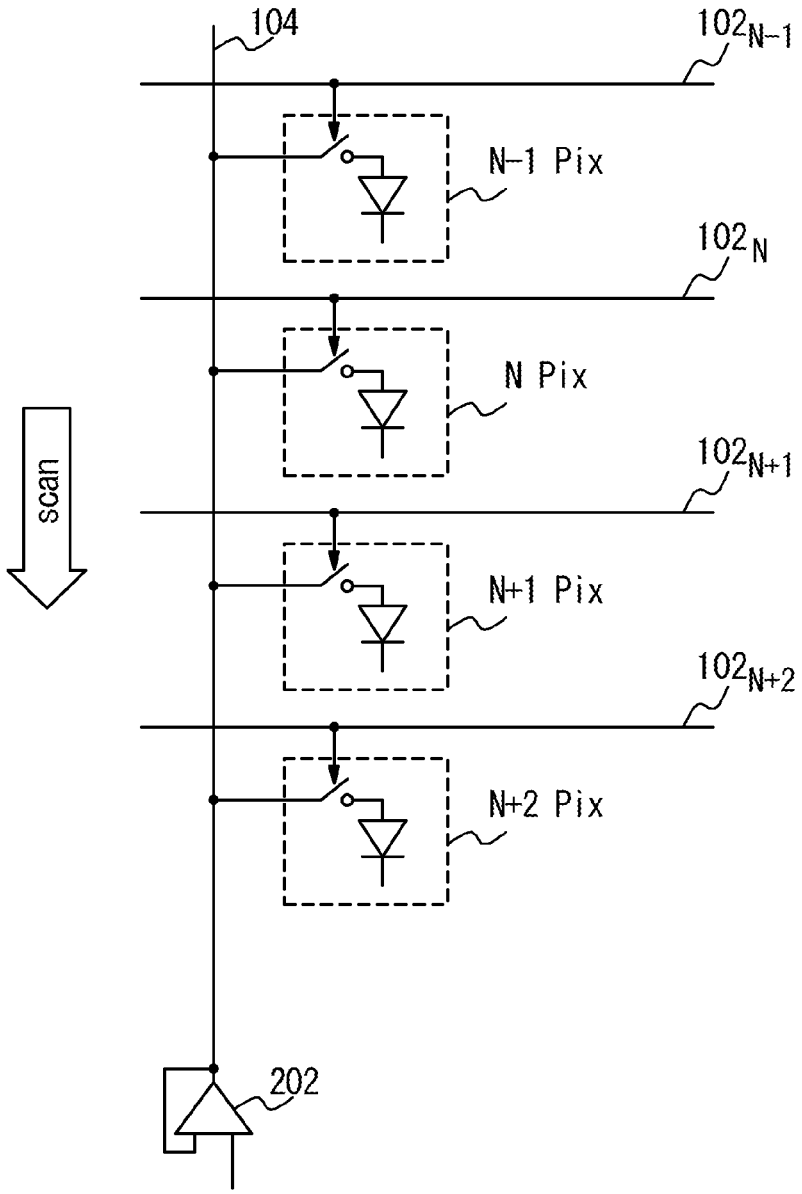
FIG. 4 illustrates example successive updates of subpixels coupled to the same data line, according to one or more embodiments.

FIG. 4 illustrates example successive updates of subpixels, denoted by "N−1 Pix", "N Pix", "N+1 Pix", and "N+2 Pix", according to one or more embodiments. It is noted that the subpixels "N−1 Pix", "N Pix", "N+1 Pix", and "N+2 Pix" may correspond to the subpixels 114 or 124 illustrated in FIGS. 3A and 3B. In the illustrated embodiment, the subpixels "N−1 Pix", "N Pix", "N+1 Pix", and "N+2 Pix" are coupled to scan lines $\mathbf{102}_{N-1}$,$\mathbf{102}_{N}$, $\mathbf{102}_{N+1}$, and $\mathbf{102}_{N+2}$respectively, and further coupled to the same data line 104. The reference numeral 202 denotes a data amplifier of the display driver 200, the data driver 202 being configured to generate drive voltages with which the subpixels "N−1 Pix", "N Pix", "N+1 Pix", and "N+2 Pix" are updated. The updates of the subpixels "N−1 Pix", "N Pix", "N+1 Pix", and "N+2 Pix" may be achieved by programming the subpixels "N−1 Pix", "N Pix", "N+1 Pix", and "N+2 Pix" with the drive voltages corresponding to graylevels specified by the corresponding subpixel data while the scan lines $\mathbf{102}_{N-1}$, $\mathbf{102}_{N}$, and $\mathbf{102}_{N+2}$ are scanned.

Figure 5:
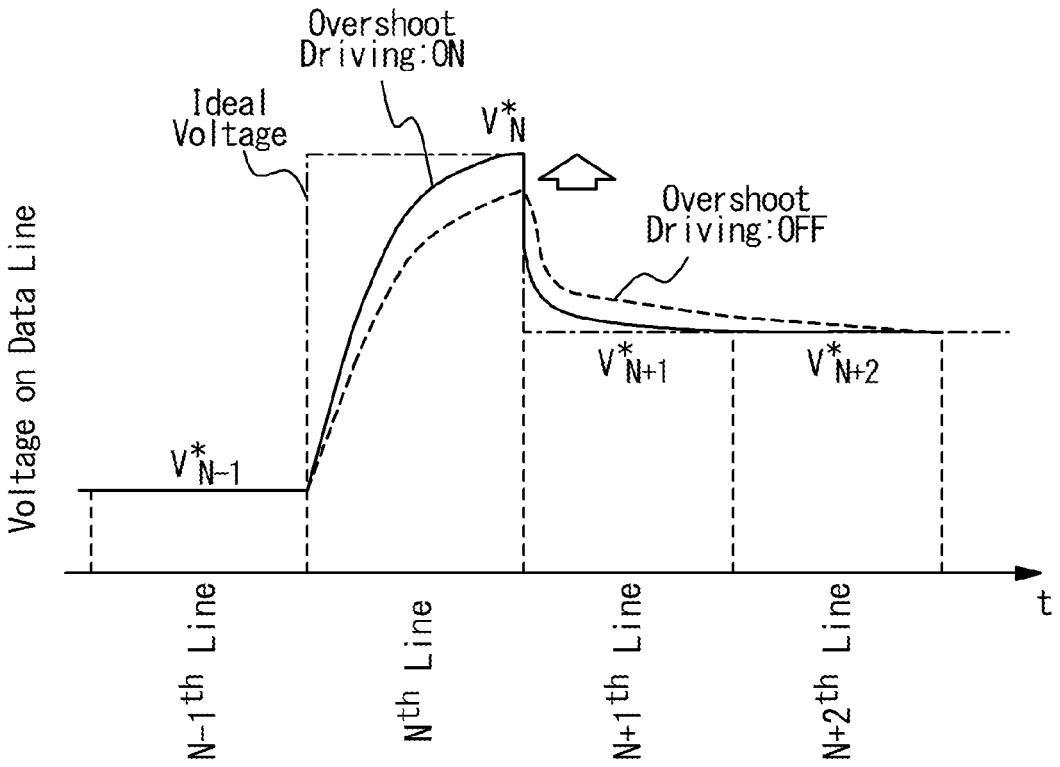
FIG. 5 illustrates example changes in the voltage on a data line, according to one or more embodiments.

FIG. 5 illustrates example changes in the voltage on the data line 104 in the case where overshoot driving is performed and the case where overshoot driving is not performed, according to one or more embodiments. In FIG. 5, $V^*_{N-1}$, $V^*_{N}$, $V^*_{N+1}$, and $V^*_{N+2}$denotes desired voltage levels of the data line 104 during N−1$^{th}$, N$^{th}$, N+1$^{th}$, N+2$^{th}$ horizontal synchronization periods, which are denoted by "N−1$^{th}$ Line", "N$^{th}$ Line", "N+1$^{th}$ Line", and "N+2$^{th}$ Line", respectively. The dashed line designated as "Ideal Voltage" indicates the ideal waveform of the voltage on the data line 104.

Although the voltage on the data line 104 is desired to change as indicated by the dashed line, this does not however occur due to the capacitance of the data line 104. When the overshoot driving is not performed, as indicated by the dotted line designated as "Overshoot Driving: OFF" in FIG. 5, the driving of the data line 104 may be considerably delayed and the data line 104 may not reach the desired voltage level in each horizontal synchronization period. For example, FIG. 5 illustrates that the data line 104 does not reach the desired voltage level $V^*_N$ in the N$^{th}$ horizontal synchronization period without the overshoot driving. As indicated by the solid line designated as "Overshoot Driving: ON", the overshoot driving enhances the drive of the data line 104, making the waveform of the voltage on the data line 104 close to the ideal waveform. The overshoot driving is especially effective when the duration of the horizontal synchronization periods is short.

Figure 6:
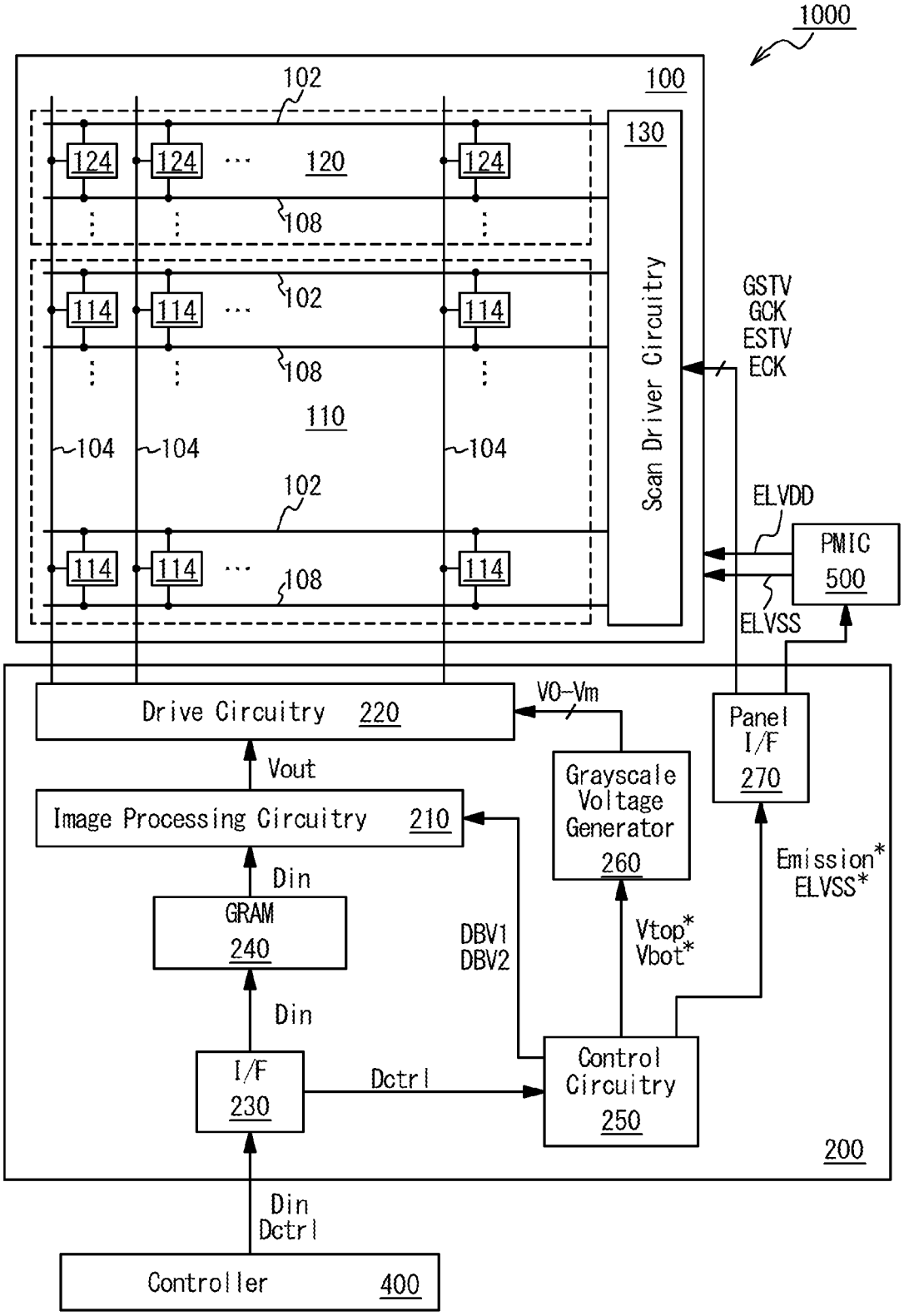
FIG. 6 illustrates an example configuration of a display device, according to one or more embodiments.

FIG. 6 illustrates an example detailed configuration of a display device 1000, according to one or more embodiments. In the illustrated embodiment, the display device 1000 is configured to display an image corresponding to image data Din received from a controller 400 external to the display device 1000. Examples of the controller 400 may include a host, an application processor, a central processing unit (CPU), or other processors. The display device 1000 includes a display panel 100 and a display driver 200. The display panel 100 may include a self-luminous display panel, such as an organic light emitting diode (OLED) display panel and a micro light emitting diode (LED) display panel. In other embodiments, the display panel 100 may be a liquid crystal display panel or a different type of display panel.

In the illustrated embodiment, the display panel 100 is configured as an OLED display panel that includes a first region 110 with a first pixel layout and a second region 120 with a second pixel layout different from the first pixel layout. The first region 110 includes subpixels 114 and the second region 120 includes subpixels 124. The display panel 100 further includes scan lines 102, data lines 104, and emission lines 108. The scan lines 102 and the emission lines 108 are coupled to the scan driver circuitry 130 and the data lines 104 are coupled to the display driver 200. The scan lines 102 and the emission lines 108 are extended in the horizontal direction of the display panel 100, and the data lines 104 are extended in the vertical direction. Each of the subpixels 114 and 124 is coupled to a corresponding scan line 102, a corresponding data line 104, and a corresponding emission line 108.

The subpixels 114 and 124 are each configured to be updated or programmed with a drive voltage received from the display driver 200. In one or more embodiments, updating or programming a subpixel 114 or 124 coupled to a scan line 102, a data line 104, and an emission line 108 may be achieved by asserting the scan line 102 in a state in which the emission line 108 is deasserted and the drive voltage is supplied to the data line 104. The subpixels 114 and 124 are each further configured to emit light with a luminance corresponding to the drive voltage. In one or more embodiments, the subpixels 114 and 124 may be each configured such that the luminance of the subpixels 114 and 124 increase as the drive voltages decrease. This may be the case when the display panel 100 is configured as an OLED display panel in which p-channel thin-film transistors (TFTs) are used in the subpixels 114 and 124.

The light emission from the subpixels 114 and 124 is controlled by the emission lines 108. The subpixels 114 or 124 coupled to an emission line 108 are configured to emit light when the emission line 108 is asserted, not emitting light when deasserted.

The display panel 100 further includes scan driver circuitry 130. The scan driver circuitry 130 is configured to select subpixels 114 or 124 to be updated or programmed by selectively asserting the scan lines 102 and the emission lines 108. The scan driver circuitry 130 is configured to, when the subpixels 114 or 124 coupled to a scan line 102 and an emission line 108 are programmed or updated, assert the scan line 102 and deassert the emission line 108. The scan driver circuitry 130 is configured to sequentially assert the scan lines 102 to update or program the subpixels 114 and 124. The assertion and deassertion of the scan lines 102 may be controlled based on a gate scan control signal GSTV in synchronization with a gate clock GCK, where the gate scan control signal GSTV and the gate clock GCK are received from the display driver 200.

The scan driver circuitry 130 is further configured to control light emission from the subpixels 114 and 124 by asserting and deasserting the emission lines 108. In displaying an image, selected ones of the emission lines 108 are asserted to allow the subpixels 114 and 124 coupled thereto to emit light, and the selection of the asserted emission lines 108 is successively shifted over the array of the emission lines 108 in synchronization with an emission clock ECK received from the display driver 200. The assertion and deassertion of the emission lines 108 are controlled based on an emission control signal ESTV received from the display driver 200.

In one or more embodiments, the emission control signal ESTV may be generated as a pulse-width modulated (PWM) signal and the display brightness level of the display device 1000 may be controlled by the duty ratio of the emission control signal ESTV. The duty ratio of the emission control signal ESTV may correspond to the ratio of a period during which the emission control signal ESTV is asserted to one cycle period of the emission control signal ESTV. In one or more embodiments, when the duty ratio of the emission control signal ESTV increases, the ratio of the number of asserted emission lines 108 to the total number of the emission lines 108 increases, and the ratio of the subpixels 114 and 124 that emit light to the total number of subpixels 114 and 124 also increases, resulting in an increase in the display brightness level of the display device 1000.

The display panel 100 is configured to receive a high-side power source voltage ELVDD and a low-side power source voltage ELVSS from a power management integrated circuit (PMIC) 500. The high-side power source voltage ELVDD and the low-side power source voltage ELVSS are delivered to the respective subpixels 114 and 124 via power source lines (not illustrated.)

In one or more embodiments, the display driver 200 is configured to control the display panel 100 based on image data Din and control data Dctrl received from the controller 400 to display an image corresponding to the image data Din on the display panel 100. The image data Din may include graylevels of the subpixels 114 and 124 of the display panel 100. The control data Dctrl may include a display brightness value (DBV) that specifies a desired display brightness level of the display device 1000. The display brightness level may be the brightness level of the entire image displayed on the display panel 100. The DBV may be generated based on a user operation. For example, when an instruction to adjust the brightness of an image displayed on the display device 1000 is manually input to an input device (not illustrated), the controller 400 may generate the DBV based on this instruction to adjust the display brightness level. The input device may include a touch panel disposed on at least a portion of the display panel 100, a cursor control device, and mechanical and/or non-mechanical buttons.

In the illustrated embodiment, the display driver 200 includes image processing circuitry 210 and drive circuitry 220 described in relation to FIG. 2A. The display driver 200 further includes interface (I/F) circuitry 230, a graphic random-access memory (GRAM) 240, control circuitry 250, grayscale voltage generator 260, and panel interface circuitry 270.

In one or more embodiments, the interface circuitry 230 is configured to receive the image data Din and the control data Dctrl from the controller 400. The interface circuitry 230 may be further configured to forward the image data Din to the GRAM 240 and forward the control data Dctrl to the control circuitry 250. In other embodiments, the interface circuitry 230 may be configured to process the image data Din and send the processed input image data Din to the GRAM 240.

The GRAM 240 is configured to temporarily store the image data Din received from the interface circuitry 230 and forward the image data Din to the image processing circuitry 210. In other embodiments, the GRAM 240 may be omitted and the image data Din may be directly transferred from the interface circuitry 230 to the image processing circuitry 210.

In one or more embodiments, the image processing circuitry 210 is configured to process the image data Din received from the GRAM 240 to generate resulting voltage data Vout. The resulting voltage data Vout may include voltage levels of drive voltages with which the respective subpixels 114 and 124 of the display panel 100 are to be updated or programmed. In the illustrated embodiment, the processing performed by the image processing circuitry 210 includes the overshoot driving process described in relation to FIGS. 1A, 1B, and 5. The processing performed by the image processing circuitry 210 may further include one or more other processes (e.g., gamma transformation, color adjustment, image scaling, etc.). Details of the image processing circuitry 210 will be described later in detail.

The drive circuitry 220 is configured to generate and provide the drive voltages to the respective subpixels 114 and 124 of the display panel 100 based on the resulting voltage data Vout received from the image processing circuitry 210. In one implementation, the drive circuitry 220 is configured to receive grayscale voltages V0-Vm from the grayscale voltage generator 260 and generate the drive voltages by selecting the grayscale voltages V0 to Vm corresponding to the voltage levels specified by the resulting voltage data Vout for the respective subpixels 114 and 124 and outputting the selected grayscale voltages as the drive voltages for the respective subpixels 114 and 124. In one implementation, the drive voltage to be supplied to each subpixel 114 or 124 ranges from Vm to V0 and increases as the corresponding voltage levels specified by the resulting voltage data Vout increases.

The grayscale voltage generator 260 is configured to generate and supply (m+1) grayscale voltages V0 to Vm to the drive circuitry 220. In various embodiments, the (m+1) grayscale voltages V0 to Vm have different voltage levels from each other. In embodiments where the grayscale voltage V0 is the highest grayscale voltage and the grayscale voltage Vm is the lowest grayscale voltage, the grayscale voltage generator 260 may be configured to generate the highest grayscale voltage V0 and the lowest grayscale voltage Vm and further generate the intermediate grayscale voltages V1 to V(m−1) through voltage dividing of the grayscale voltages V0 and Vm. In such embodiments, the highest grayscale voltage V0 and the lowest grayscale voltage Vm may control the display brightness level since the display brightness level of the display device 1000 depends on the range of the drive voltages with which the subpixels 114 and 124 are updated or programmed.

The voltage level of the highest grayscale voltage V0 may be specified by a top voltage command value Vtop* received from the control circuitry 250, and the voltage level of the lowest grayscale voltage Vm may be specified by a bottom voltage command value Vbot* received from the control circuitry 250. In such embodiments, the range of the drive voltages, that is, the display brightness level of the display device 1000 may be controlled based at least in part on the top voltage command value Vtop* and the bottom voltage command value Vbot*.

The panel interface circuitry 270 is configured to generate the gate scan control signal GSTV, the gate clock GCK, the emission control signal ESTV, and the emission clock ECK to control the scan driver circuitry 130 of the display panel 100. In one or more embodiments, the panel interface circuitry 270 is configured to control the duty ratio of the emission control signal ESTV based on an emission command Emission* received from the control circuitry 250. The emission command Emission* may specify a desired duty ratio of the emission control signal ESTV. In embodiments where the display brightness level of the display device 1000 is controllable with the emission control signal ESTV, the display brightness level is controllable with the emission command Emission*.

The panel interface circuitry 270 may be further configured to control the low-side power supply voltage ELVSS based on an ELVSS command ELVSS* received from the control circuitry 250. In such embodiments, the panel interface circuitry 270 may be configured to generate and supply a control signal to the PMIC 500 to adjust the low-side power supply voltage ELVSS as specified by the ELVSS command ELVSS*.

In one or more embodiments, the control circuitry 250 is configured to control the operations of the image processing circuitry 210, the grayscale voltage generator 260, and the panel interface circuitry 270 based on the control data Dctrl received from the controller 400. In embodiments where the control data Dctrl includes the DBV, which specifies the display brightness level of the display device 1000, the control circuitry 250 may be configured to control the display brightness level of the display device 1000 based on the DBV by controlling the image processing circuitry 210, the grayscale voltage generator 260, and the panel interface circuitry 270.

In various embodiments, the control circuitry 250 is configured to generate and supply a first display brightness value DBV1 and a second display brightness value DBV2 to the image processing circuitry 210. The first display brightness value DBV1 may specify a desired brightness level of the first region 110 and the second display brightness value DBV2 may specify a desired brightness level of the second region 120. The image processing circuitry 210 is configured to process image data Din for the first region 110 in accordance with the first display brightness value DBV1 and process the image data Din for the second region 120 in accordance with the second display brightness value DBV2. The first display brightness value DBV1 and the second display brightness value DBV2 may be depend on the operation of the system that includes the display device 1000. For example, in embodiments where the second region 120 is used as a camera hole region behind which a camera is disposed (for example, as illustrated in FIG. 2B), the first display brightness value DBV1 may be determined as equal to the DBV and the second display brightness value DBV2 may be determined as a value lower than the DBV while the camera is operated to capture an image. In other embodiments, the control data Dctrl may include the first display brightness value DBV1 and the second display brightness value DBV2. The control circuitry 250 may be further configured to generate the top voltage command value Vtop*, the bottom voltage command value Vbot*, the emission command Emission*, and/or the ELVSS command ELVSS* based on the DBV to control the display brightness level of the display device 1000.

Figure 7:
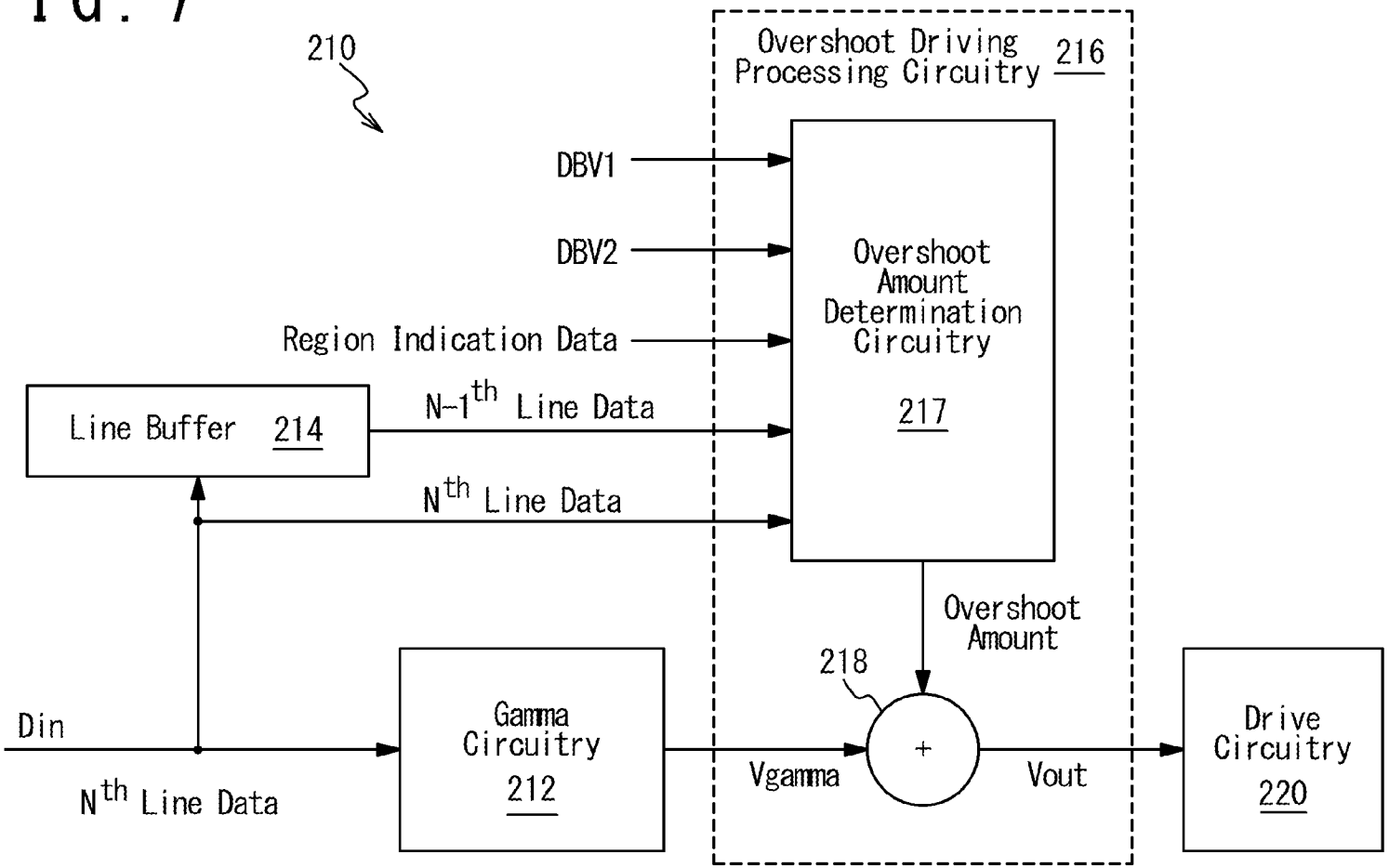
FIG. 7 illustrates an example configuration of image processing circuitry, according to one or more embodiments.

FIG. 7 illustrates an example configuration of the image processing circuitry 210, according to one or more embodiments. The image processing circuitry 210 includes gamma circuitry 212, a line buffer 214, and overshoot driving processing circuitry 216. The gamma circuitry 212 is configured to apply a gamma transformation to the image data Din to generate gamma voltage data Vgamma. The gamma voltage data Vgamma may include voltage levels with which the subpixels 114 and 124 are to be updated. The gamma transformation may transform the graylevels of the image data Din into voltage levels of the gamma voltage data Vgamma in accordance with a specified gamma curve of the display device 1000.

The line buffer 214 is configured to latch and store image data Din for one horizontal line and forward the stored image data Din to the overshoot driving processing circuitry 216 with a delay of one horizontal synchronization period. The horizontal line referred herein is a row of subpixels 114 and/or 124 coupled to one scan line 102. In FIG. 7, $N^{th}$ line data refers to image data Din for a horizontal line to be updated during the current horizontal synchronization period. The $N^{th}$ line data includes subpixel data for the horizontal line to be updated during the current horizontal synchronization period (that is, subpixel data for the scan line 102 to be activated during the current horizontal synchronization period). Correspondingly, N-$1^{th}$ line data refers to image data Din for the adjacent horizontal line updated during the preceding horizontal synchronization period. The N-$1^{th}$ line data includes subpixel data for the adjacent horizontal line (that is, subpixel data for the scan line 102 activated during the preceding horizontal synchronization period). The line buffer 214 is configured to provide the N-$1^{th}$ line data to the overshoot driving processing circuitry 216.

The overshoot driving processing circuitry 216 includes overshoot amount determination circuitry 217 and correction circuitry 218. The overshoot amount determination circuitry 217 may be configured to receive the $N^{th}$ line data and the N-$1^{th}$ line data and determine overshoot amounts for the respective data lines 104 for the current horizontal synchronization period based on the $N^{th}$ line data and the $N\text{-}1^{th}$ line data.

The overshoot amount determination circuitry 217 is further configured to adjust the overshoot amounts adaptively to the pixel layouts of the first region 110 and the second region 120 and/or the brightness levels of the first region 110 and the second region 120. To achieve the adaptive adjustment of the overshoot amounts, in various embodiments, the overshoot amount determination circuitry 217 may be further configured to receive region indication data, the first display brightness value DBV1, and the second display brightness value DBV2 from the controller circuitry 250 (illustrated in FIG. 6) and determine the overshoot amounts for the respective data lines 104 further based on the region indication data, the first display brightness value DBV1, and the second display brightness value DBV2. The region indication data may indicate voltage data for which an overshoot amount is to be determined is for the first region 110 or for the second region 120.

The correction circuitry 218 is configured to modify the gamma voltage data Vgamma based on the overshoot amounts to generate the resulting voltage data Vout. In one implementation, the correction circuitry 218 is configured to determine the voltage level specified by the resulting voltage data Vout for a specific data line 104 by adding the corresponding overshoot amount to the voltage level specified by the gamma voltage data Vgamma for the specific data line 104.

Figure 8:
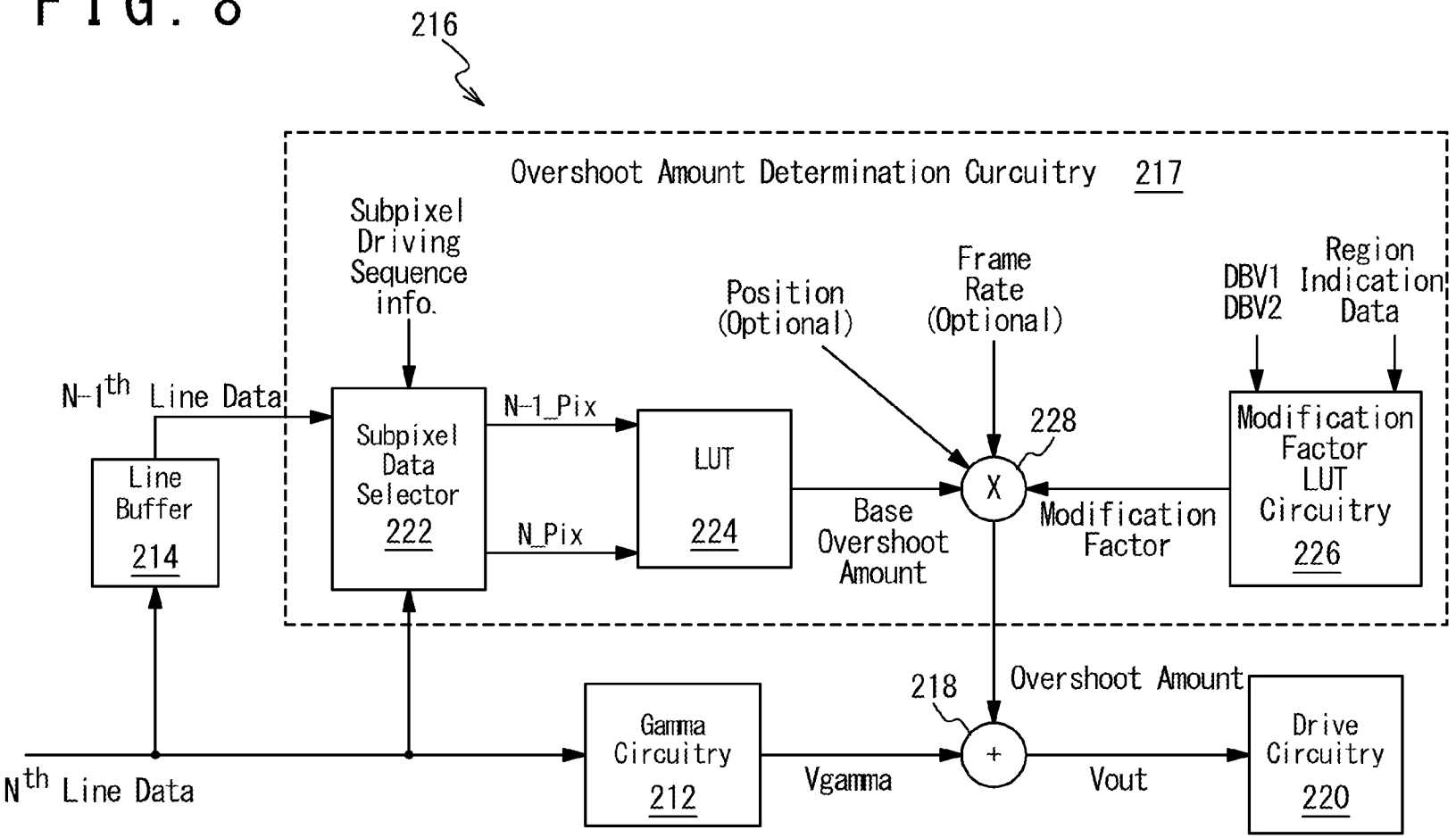
FIG. 8 illustrates an example configuration of overshoot amount determination circuitry, according to one or more embodiments.

FIG. 8 illustrates an example configuration of the overshoot amount determination circuitry 217, according to one or more embodiments. In the illustrated embodiment, the overshoot amount determination circuitry 217 includes a subpixel data selector 222, lookup table (LUT) circuitry 224, modification factor LUT circuitry 226, and modification circuitry 228. The term "table" refers to any storage mechanism that relates sets of values.

The subpixel data selector 222 is configured to select subpixel data for each data line 104 from the $N\text{-}1^{th}$ line data and the $N^{th}$ line data. The selected subpixel data for each data line 104 includes subpixel data N-1_Pix for the preceding horizontal synchronization period (that is, subpixel data for the scan line 102 activated during the preceding horizontal synchronization period), which is selected from the $N\text{-}1^{th}$ line data, and subpixel data N_Pix for the current horizontal synchronization period (that is, subpixel data for the scan line 102 to be activated during the current horizontal synchronization period), which is selected from the $N^{th}$ line data. The subpixel data selector 222 is further configured to forward the selected subpixel data to the LUT circuitry 224.

The LUT circuitry 224 is configured to determine, for each data line 104, a base overshoot amount based on the subpixel data N-1_Pix for the preceding horizontal synchronization period and the subpixel data N_Pix for the current horizontal synchronization period, which are received from the subpixel data selector 222. The base overshoot amount may be main part of the overshoot amount used to modify the voltage level of the corresponding gamma voltage data Vgamma. As described later in detail, the overshoot amount used to modify the gamma voltage data Vgamma is generated by modifying the base overshoot amount.

The LUT circuitry 224 may be configured to determine the base overshoot amount for each data line 104 based on the difference in the graylevel between the subpixel data N-1_Pix and the subpixel data N_Pix. In some embodiments, the base overshoot amount may be positive when the graylevel specified by the subpixel data N_Pix is larger than the graylevel specified by the subpixel data N-1_Pix. In such embodiments, the base overshoot amount may increase as the difference in the graylevel between the subpixel data N-1_Pix and the subpixel data N increases. In some embodiments, the base overshoot amount may be negative when the graylevel specified by the subpixel data N_Pix is smaller than the graylevel specified by the subpixel data N-1_Pix. In such embodiments, the absolute value of the base overshoot amount may increase as the absolute value of the difference in the graylevel between the subpixel data N-1_Pix and the subpixel data N increases.

In one or more embodiments, the LUT circuitry 224 may include an LUT configured to store base overshoot amounts for respective combinations of the graylevels of the subpixel data N-1_Pix for the preceding horizontal synchronization period and the graylevels of the subpixel data N_Pix for the current horizontal synchronization period. In such embodiments, the LUT circuitry 224 may be configured to determine the base overshoot amount through a table lookup using the graylevel of the subpixel data N-1_Pix and the graylevel of the subpixel data N_Pix for each data line 104 as indices into the LUT.

In one implementation, the LUT circuitry 224 may be configured to, when the graylevel of the subpixel data N_Pix is larger than the graylevel of the subpixel data N-1_Pix, determine the base overshoot amount as being positive such that the overshoot amount increases as the difference between the graylevel of the subpixel data N_Pix and the graylevel of the subpixel data N-1_Pix increases. The LUT circuitry 224 may be further configured to, when the graylevel of the subpixel data N_Pix is lower than the graylevel of the subpixel data N-1_Pix, determine the base overshoot amount as being negative such that the absolute value of the overshoot amount increases as the absolute value of the difference between the graylevel of the subpixel data N_Pix and the graylevel of the subpixel data N-1_Pix increases.

The modification factor LUT circuitry 226 is configured to determine, for each data line 104, a modification factor based on the first display brightness value DBV1, the second display brightness value DBV2, and the region indication data. Details of the determination of the modification factor will be described later.

The modification circuitry 228 is configured to determine an overshoot amount for each data line 104 by modifying the base overshoot amount received from the LUT circuitry 224 based on the modification factor received from the modification factor LUT circuitry 226. In one implementation, the modification circuitry 228 may be configured to determine the overshoot amount by multiplying the base overshoot amount by the modification factor. The modification circuitry 228 is further configured to send the overshoot amount thus determined to the correction circuitry 218, which is configured to generate the resulting voltage data by modifying the gamma voltage data based on the overshoot amount.

It is noted that the overshoot amounts are determined based on the subpixel data, which are not yet subjected to the gamma translation. By determining the overshoot amounts based on the subpixel data which are not yet subjected to the gamma translation, it is possible to properly determine the overshoot amounts in line with the display brightness control performed by other circuitry in the display driver 200. As discussed above in relation to FIG. 6, the control circuitry 250 may be configured to control the display brightness level by the emission command Emission*, the top voltage command value Vtop*, the bottom voltage command value Vbot* and/or the ELVSS command ELVSS*. In such embodiments, the overshoot amounts can be determined in consideration of the control of the display brightness level.

Figure 9:
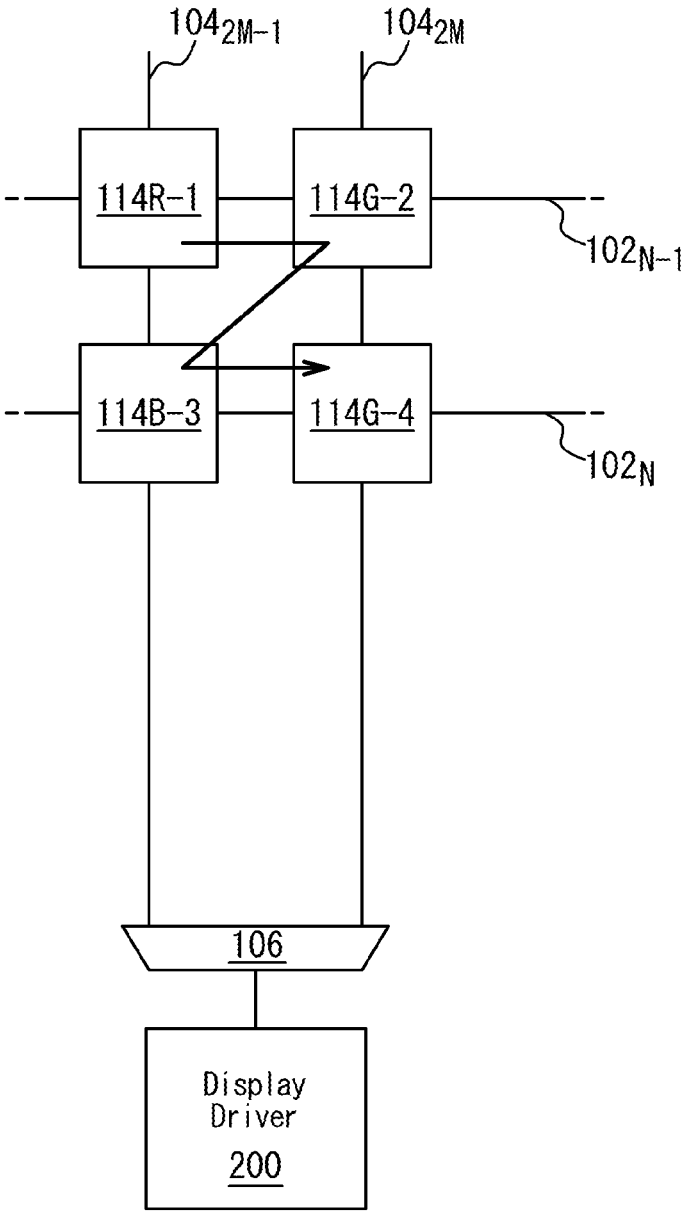
FIG. 9 illustrates an example sequence of driving subpixels, according to one or more embodiments.

In some embodiments, as illustrated in FIG. 9, the display panel 100 may include multiplexers 106 (one illustrated) configured to sequentially select the data lines 104 and the data lines 104 are time-divisionally driven in each horizontal synchronization period by using the multiplexers 106. In such embodiments, the subpixel data selector 222 may be configured to select, for each data line 104, the subpixel data N-1_Pix from the N-1$^{th}$ line data and the subpixel data N_Pix form the N$^{th}$ line data based on subpixel driving sequence information that indicates the sequence in which the data lines 104 are driven in each horizontal synchronization period.

In the illustrated embodiment, each multiplexer 106 is coupled to two data lines, denoted by the reference numerals $\mathbf{104}_{2M-1}$ and $\mathbf{104}_{2M}$. The data line $\mathbf{104}_{2M-1}$is coupled to an R subpixel 114R-1 and a B subpixel 114B-3. The data line $\mathbf{104}_{2M}$ is coupled to a G subpixel 114G-2 and a G subpixel 114G-4. The R subpixel 114R-1 and the G subpixel 114G-2 are coupled to a scan line $\mathbf{102}_{N-1}$. The B subpixel 114B-3 and the G subpixel 114G-4 are coupled to a scan line $\mathbf{102}_{N}$. It is noted the R subpixel 114R-1 and the G subpixel 114G-2 are updated during an N-1$^{th}$ horizontal synchronization period and the B subpixel 114B-3 and the G subpixel 114G-4 are updated during an N$^{th}$ horizontal synchronization period that follows the N-1$^{th}$ horizontal synchronization period. The scan line $\mathbf{102}_{N-1}$ is activated during the N-1$^{th}$ horizontal synchronization period, and the scan line $\mathbf{102}_{N}$ is activated during the N$^{th}$ horizontal synchronization period.

In some embodiments, the drive operation during the N-1$^{th}$ horizontal synchronization period includes first updating the R subpixel 114R-1 and then updating the G subpixel 114G-2, and the drive operation during the N$^{th}$ horizontal synchronization period includes first updating the B subpixel 114B-3 and then updating the G subpixel 114G-4. In such embodiments, the subpixel data selector 222 may be configured to select, based on the subpixel driving sequence information, the subpixel data for the R subpixel 114R-1 from the N-1$^{th}$ line data stored in the line buffer 214 and select the subpixel data for the B subpixel 114B-3 from the N$^{th}$ line data for determining the overshoot amount for the data line $\mathbf{104}_{2M-1}$ in the drive operation of the N$^{th}$ horizontal synchronization period. The subpixel data selector 222 may be further configured to select, based on the subpixel driving sequence information, the subpixel data for the G subpixel 114G-2 from the N-1$^{th}$ line data stored in the line buffer 214 and select the G subpixel 114G-4 from the N$^{th}$ line data for determining the overshoot amount for the data line $\mathbf{104}_{2M}$ in the drive operation of the N$^{th}$ horizontal synchronization period.

Figure 10:
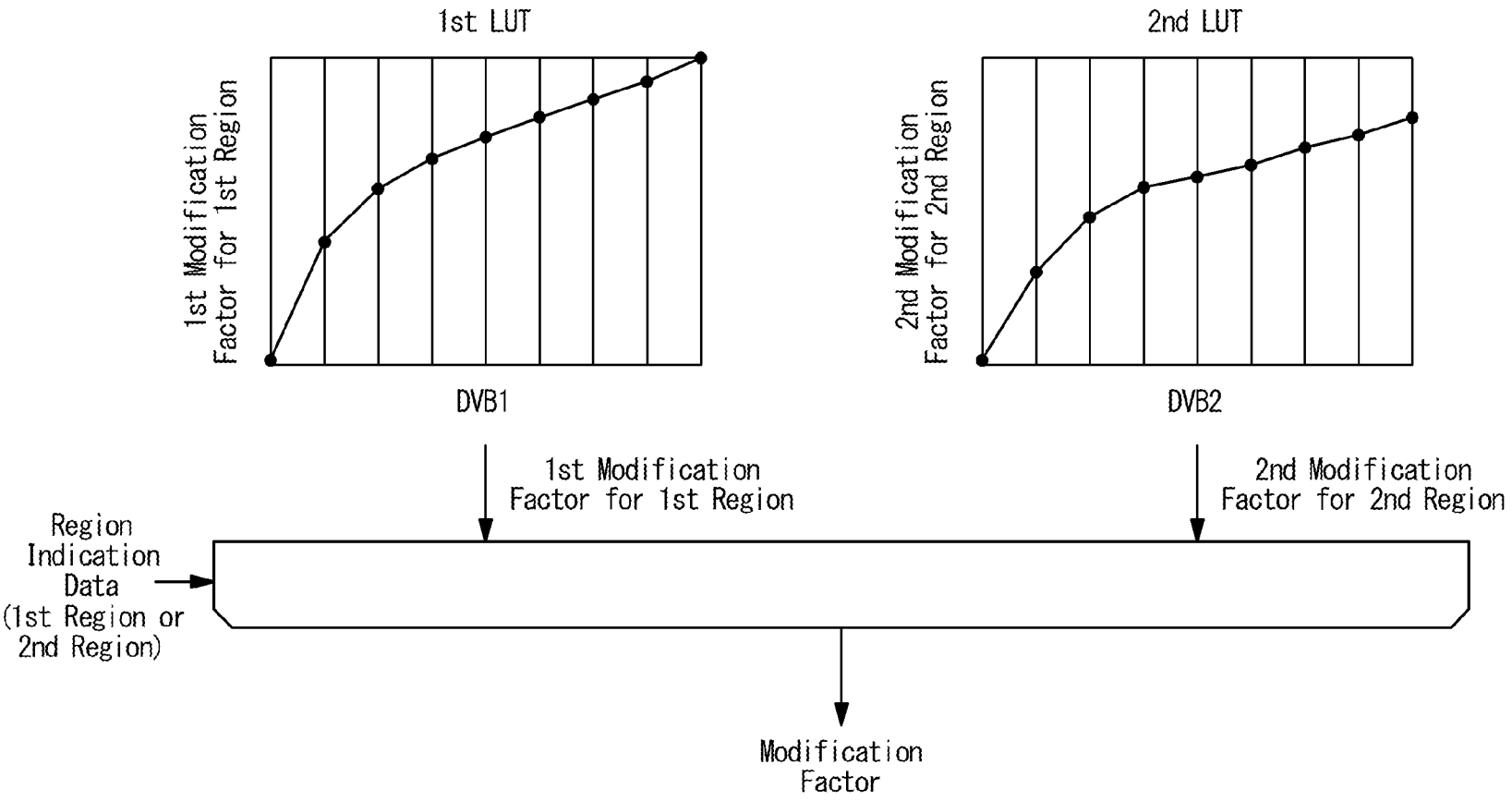
FIG. 10 illustrates an example operation of modification factor LUT circuitry, according to one or more embodiments.

FIG. 10 illustrates an example operation of the modification factor LUT circuitry 226 (illustrated in FIG. 8), according to one or more embodiments. The modification factor LUT circuitry 226 may be configured to determine the modification factor adaptively to the pixel layouts of the first region 110 and the second region 120. For the adaptive determination of the modification factor, in some embodiments, the modification factor LUT circuitry 226 may be configured to determine the modification factor based on the region indication data that indicates the resulting voltage data for which the overshoot amount is to be determined is for the first region 110 or for the second region 120.

In one implementation, the modification factor LUT circuitry 226 may include a first LUT used for determining a first modification factor for the first region 110 and a second LUT used for determining a second modification factor for the second region 120. Disposing the first LUT for the first region 110 separately from the second LUT for the second region 120 allows determining the modification factors adaptively to the pixel layouts of the first region 110 and the second region 120. The first LUT may be configured to store first modification factors for respective possible values of the first display brightness value DBV1 and the second LUT may be configured to store second modification factors for respective possible values of the second display brightness value DBV2. The modification factor LUT circuitry 226 may be configured to determine the first modification factor through a table lookup using the first display brightness value DBV1 as the index into the first LUT and determine the second first modification factor through a table lookup using the second display brightness value DBV2 as the index into the second LUT. The modification factor LUT circuitry 226 may be further configured to select one of the first modification factor and the second modification factor based on the region indication data as the modification factor to be provided to the modification circuitry 228. In one implementation, the modification factor LUT circuitry 226 is configured to select the first modification factor when the region indication data indicates that the resulting voltage data of interest is for the first region 110 and select the select modification factor when the region indication data indicates that the resulting voltage data of interest is for the second region 120.

Referring back to FIG. 8, the modification circuitry 228 may be further configured to modify the overshoot amount for the resulting voltage data based on the position of the subpixel of interest. The subpixel of interest referred herein is the subpixel for which the resulting voltage data specifies the voltage level of the drive voltage. In one implementation, the modification circuitry 228 may be further configured to determine a first additional modification factor based on the position of the subpixel of interest and modify the overshoot amount by multiplying the overshoot amount by the first additional modification factor.

Figure 11:
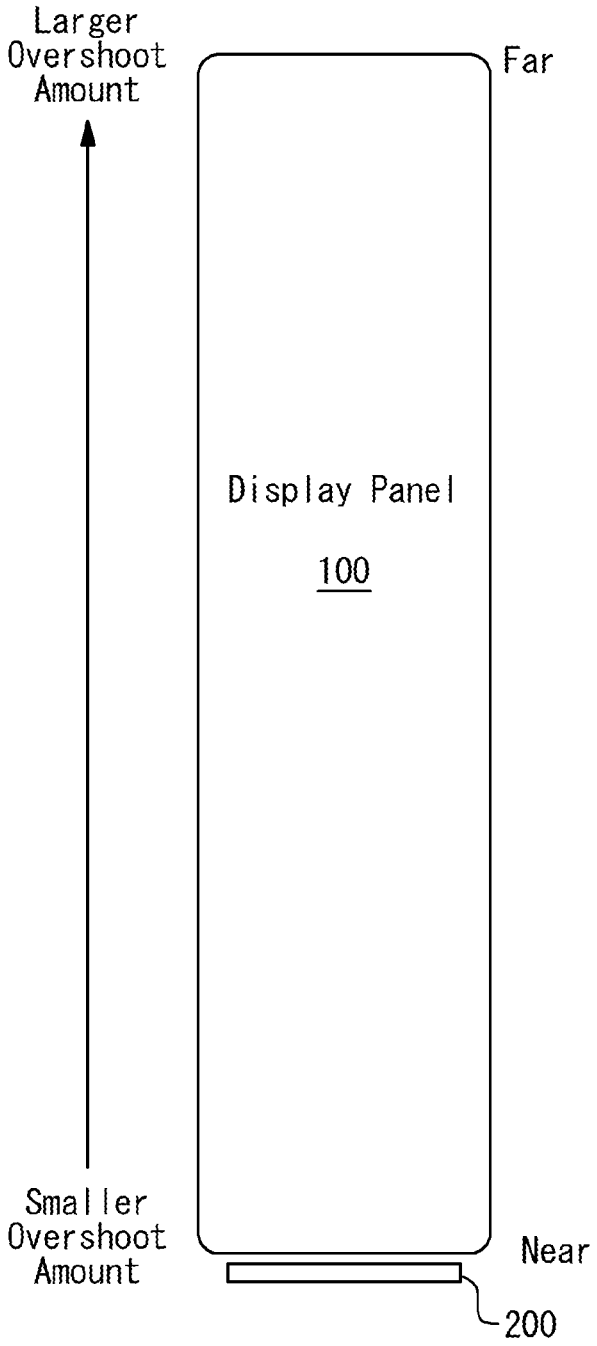
FIG. 11 illustrates an example modification of an overshoot amount based on the position of a subpixel in a display panel, according to one or more embodiments.

FIG. 11 illustrates an example modification of the overshoot amount based on the position of the subpixel of interest in the display panel 100, according to one or more embodiments. In some embodiments, the modification circuitry 228 may be configured to modify the overshoot amount such that the overshoot amount increases as the distance between the subpixel of interest and the display driver 200 increases. The overshoot amount may increase linearly or non-linearly to the distance between the subpixel of interest and the display driver 200. Since the delay in the driving of a data line 104 increases as the distance from the display driver 200 increases, increasing the overshoot amount as the distance between the subpixel of interest and the display driver 200 increases may effectively mitigate the effect of the delay in the driving of the data line 104.

Referring back to FIG. 8, the modification circuitry 228 may be further configured to modify the overshoot amount determined for the resulting voltage data based on the frame rate of the display device 1000 in addition to or in place of the position of the subpixel of interest. In one implementation, the modification circuitry 228 may be further configured to determine a second additional modification factor based on the frame rate and modify the overshoot amount by multiplying the overshoot amount by the second additional modification factor.

Figure 12:
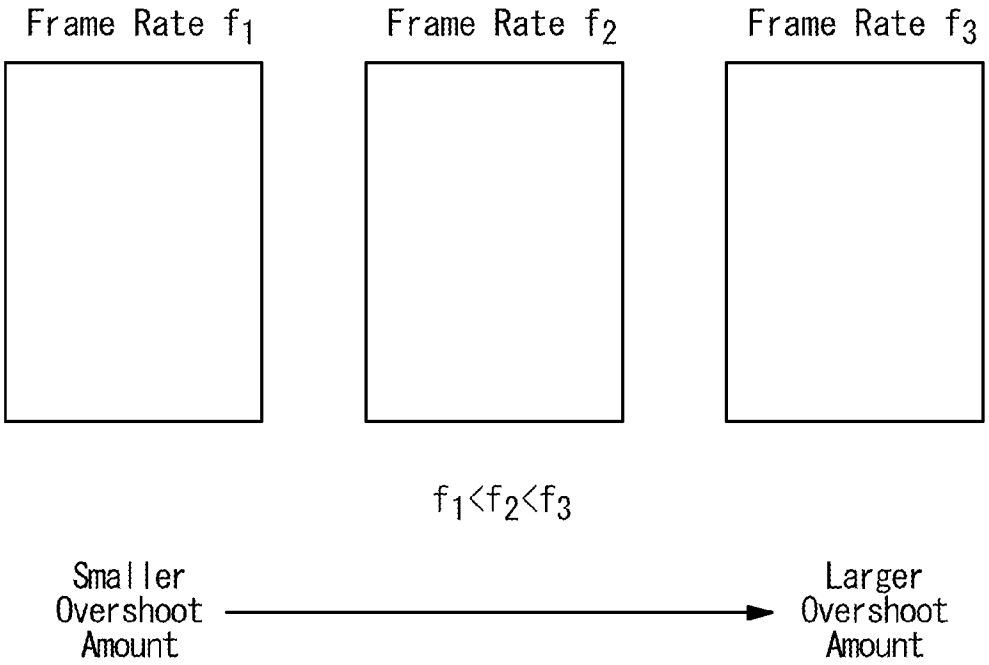
FIG. 12 illustrates an example modification of an overshoot amount based on a frame rate, according to one or more embodiments.
Figure 13:
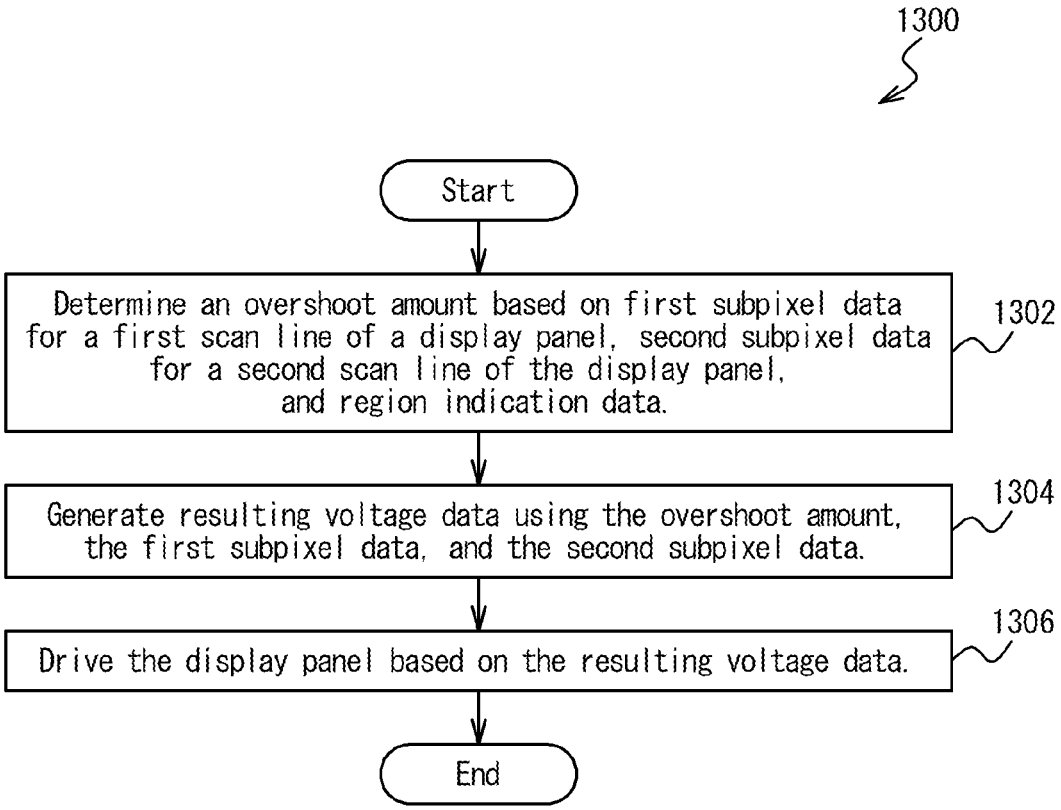
FIG. 13 illustrates example steps for overshoot driving, according to one or more embodiments.

FIG. 12 illustrates an example modification of the overshoot amount based on the frame rate, according to one or more embodiments. The modification circuitry 228 may be configured to modify the overshoot amount such that the overshoot amount increases as the frame rate increases. Since the increase in the frame rate is accompanied by reduction of the duration of the horizontal synchronization periods, increasing the overshoot amount as the frame rate increases may effectively mitigate the effect of the delay in the driving of the data lines 104. In the illustrated embodiment, the display device 1000 is adapted to frame rates $f_1$, $f_2$, and $f_3$, where the frame rate $f_3$ is higher than the frame rate $f_2$and the frame rate $f_2$is higher than the frame rate $f_1$. In such embodiments, the modification circuitry 228 may be configured to modify the overshoot amount such that the overshoot amount for the frame rate $f_3$ is larger than the overshoot amount for the frame rate $f_2$ and the overshoot amount for the frame rate $f_2$ is larger than the overshoot amount for the frame rate Method 1300 of FIG. 13 illustrates example steps for overshoot driving, according to one or more embodiments. It is noted that one or more of the steps illustrated in FIG. 13 may be repeated and/or performed in a different order than the order illustrated in FIG. 13. It is further noted that two or more steps may be implemented at the same time.

The method includes determining an overshoot amount based on first subpixel data for a first scan line of a display panel, second subpixel data for a second scan line of the display panel, and region indication data at step 1302. The display panel includes a first region or a second region having different pixel layouts. The method further includes generating resulting voltage data using the overshoot amount, the first subpixel data, and the second subpixel data at step 1304. The region indication data indicates whether the resulting voltage data is for the first region or for the second region. The method further includes driving the display panel based on the resulting voltage data at step 1306.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

image processing circuitry configured to:

receive first subpixel data for a first scan line of a display panel, the display panel comprising:

a first region with a first pixel layout; and a second region with a second pixel layout different from the first pixel layout;

determine an overshoot amount based, at least in part, on:

the first subpixel data; and region indication data; and generate resulting voltage data using the overshoot amount, wherein the region indication data indicates whether the resulting voltage data is for the first region or for the second region; and drive circuitry configured to drive the display panel based, at least in part, on the resulting voltage data.

2. The display driver of claim 1, further comprising second subpixel data for a second scan line of the display panel, wherein the first subpixel data and the second subpixel data are for a first source line of the display panel, wherein determining the overshoot amount is further based on the second subpixel data, and wherein driving the display panel comprises driving the first source line based on the resulting voltage data.

3. The display driver of claim 1, wherein determining the overshoot amount is further based on:

second subpixel data for a second scan line of the display panel;

a first display brightness value for the first region; and a second display brightness value for the second region.

4. The display driver of claim 1, wherein determining the overshoot amount comprises:

determining a base overshoot amount based on the first subpixel data and second subpixel data for a second scan line of the display panel;

determining a modification factor based on the region indication data; and modifying the base overshoot amount based on the modification factor.

5. The display driver of claim 4, wherein the image processing circuitry is further configured to:

determine a first factor based on a first display brightness value for the first region;

determine a second factor based on a second display brightness value for the second region; and select the modification factor from the first factor and the second factor based on the region indication data.

6. The display driver of claim 1, wherein the image processing circuitry is further configured to:

apply a gamma transformation to the first subpixel data to generate gamma voltage data, wherein the resulting voltage data is generated by modifying the gamma voltage data based on the overshoot amount.

7. The display driver of claim 1, wherein the image processing circuitry further comprises:

second subpixel data for a second scan line of the display panel, a line buffer configured to store a set of subpixel data for a plurality of source lines of the display panel for the second scan line, and a subpixel data selector configured to select the second subpixel data from the set of subpixel data.

8. The display driver of claim 7, wherein selecting the second subpixel data is based on a sequence in which subpixels for the first scan line and the second scan line are driven.

9. The display driver of claim 1, wherein the first subpixel data is for a first subpixel coupled to the first scan line, wherein determining the overshoot amount is further based on a position of the first subpixel in the display panel.

10. The display driver of claim 9, wherein the overshoot amount increases as a distance between the first subpixel and the display driver increases.

11. The display driver of claim 1, wherein determining the overshoot amount is further based on a frame rate.

12. The display driver of claim 11, wherein the overshoot amount increases as the frame rate increases.

13. A display device, comprising:

a display panel comprising:

a first region with a first pixel layout; and a second region with a second pixel layout different from the first pixel layout; and a display driver configured to:

receive first subpixel data for a first scan line of a display panel;

determine an overshoot amount based, at least in part, on:

the first subpixel data; and region indication data;

generate resulting voltage data using the overshoot amount, wherein the region indication data indicates whether the resulting voltage data is for the first region or for the second region; and drive the display panel based, at least in part, on the resulting voltage data.

14. The display device of claim 13, wherein the second region has a lower pixel density than the first region.

15. The display device of claim 13, wherein the display driver is further configured to receive second subpixel data for a second scan line of the display panel, wherein the first subpixel data and the second subpixel data are for a first source line of the display panel, wherein determining the overshoot amount is further based on the second subpixel data, and wherein driving the display panel comprises driving the first source line based on the resulting voltage data.

16. The display device of claim 13, wherein determining the overshoot amount is further based on:

second subpixel data for a second scan line of the display panel;

a first display brightness value for the first region; and a second display brightness value for the second region.

17. The display device of claim 13, wherein the display driver is further configured to:

receive second subpixel data for a second scan line of the display panel;

store in a line buffer a set of subpixel data for a plurality of source lines of the display panel for the second scan line; and select the second subpixel data from the set of subpixel data based on a sequence in which drive subpixels for the first scan line and the second scan line are driven.

18. A method, comprising:

determining an overshoot amount based on:

first subpixel data for a first scan line of a display panel, the display panel comprising:

a first region with a first pixel layout; and a second region with a second pixel layout different from the first pixel layout;

second subpixel data for a second scan line of the display panel, the second scan line being activated prior to the first scan line; and region indication data; and generating resulting voltage data using the overshoot amount, the first subpixel data and the second subpixel data, wherein the region indication data indicates whether the resulting voltage data is for the first region or for the second region.

19. The method of claim 18, wherein the first subpixel data and the second subpixel data are for a first source line of the display panel, wherein the method further comprised driving the first source line based on the resulting voltage data.

20. The method of claim 18, wherein determining the overshoot amount is further based on:

a first display brightness value for the first region; and a second display brightness value for the second region.

* * * * *